United States Patent [19]

Kmicikiewicz

[11] Patent Number: 4,727,794

[45] Date of Patent: Mar. 1, 1988

[54] RADIAL ENGINE

[76] Inventor: Marek A. Kmicikiewicz, 2100 Chomedey Street, Apt. 301, Montreal, Quebec, Canada, H3H 2A9

[21] Appl. No.: 4,562

[22] Filed: Jan. 20, 1987

[51] Int. Cl.[4] ..... F01B 1/06; F02B 75/22

[52] U.S. Cl. ..... 91/491; 123/55 A; 123/197 R

[58] Field of Search ..... 123/44 R, 55 R, 55 A, 123/55 AA, 197 A, 197 AB, 197 AC, 197 R; 91/491; 417/273

[56] References Cited

U.S. PATENT DOCUMENTS

| | | | |
|---|---|---|---|
| 603,805 | 5/1898 | Wood | 417/273 |
| 1,445,474 | 2/1923 | Benson et al. . | |
| 1,612,985 | 1/1927 | Quick . | |
| 1,708,611 | 4/1929 | Felt . | |
| 1,774,087 | 8/1930 | Dunn . | |
| 1,780,854 | 11/1930 | Watts et al. . | |
| 1,783,589 | 12/1930 | Shepard . | |
| 2,105,846 | 1/1938 | Ruliancich . | |
| 2,120,657 | 6/1938 | Tucker . | |
| 2,612,837 | 10/1952 | Midgette | 417/273 X |
| 2,621,607 | 12/1952 | Trapp | 417/273 |
| 2,818,816 | 1/1958 | Christenson | 417/273 |
| 3,570,372 | 3/1971 | Campbell | 91/496 |
| 4,331,108 | 5/1982 | Collins . | |

FOREIGN PATENT DOCUMENTS

| | | |
|---|---|---|
| 2024938 | 1/1980 | United Kingdom . |

*Primary Examiner*—Michael Koczo

*Attorney, Agent, or Firm*—Diller, Ramik & Wight

[57] ABSTRACT

The disclosure teaches a novel radial engine. In accordance with the teachings of the disclosure, the radial engine includes a housing and a plurality of equally spaced openings disposed in a ring-like arrangement on the periphery of the housing. A respective piston and cylinder arrangement is located in each opening, and the piston rod of each piston and cylinder arrangement extends inwardly from its respective piston through its respective opening. A shoe means is pivotally attached at the other end of each piston rod, and a connecting ring is mounted for circular translation motion on the crankshaft within the housing. A respective channel or guides extend radially inward in the housing in line with each piston rod to permit radially inward motion of the shoe means and to guide the connecting rod block in this motion. Each shoe means is guidably connected to the peripheral edge of the connecting ring.

7 Claims, 6 Drawing Figures

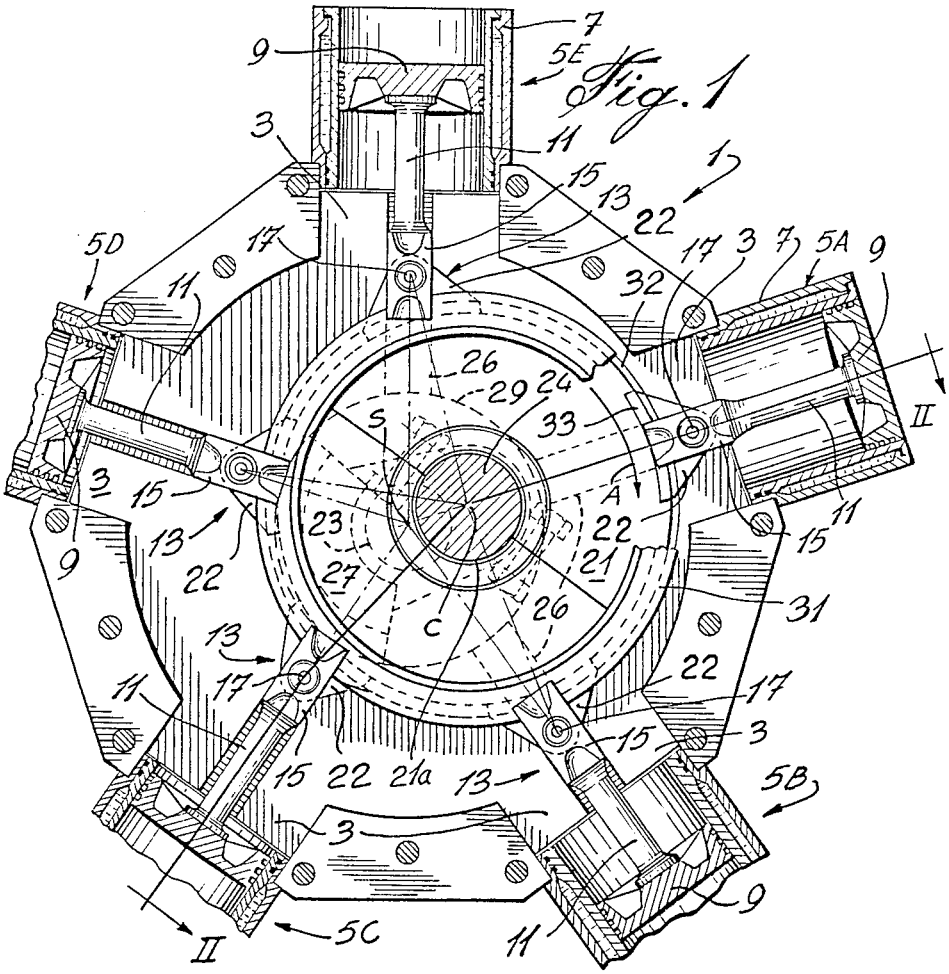
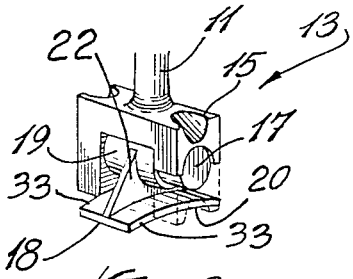
Fig. 3

RADIAL ENGINE

BACKGROUND OF THE INVENTION

1. Field of the Invention

The invention relates to an improved radial engine.

2. Description of the Prior Art

Radial engines per se are known in the art. However, the radial engines known in the art suffer from various disadvantages. For example, U.S. Pat. No. 1,445,474 teaches a radial engine with rollers at the ends of the piston rods following a cam. The rollers are not guided by the peripheral edge of the cam so that the action of the cam on the rollers will produce large lateral forces on the pistons which can in turn introduce lateral forces of the pistons on the respective cylinders. U.S. Pat. No. 1,708,611 teaches a very complicated structure which is, therefore, not rendered practical.

U.S. Pat. No. 1,774,047 also teaches a cam and roller arrangement. As in other such cam and roller arrangements, there is the problem of rotational speed of the rollers between top dead-center and bottom dead-center of the engine. Also, as in the U.S. Pat. No. 1,445,474, there are problems concerning lateral forces on the pistons. U.S. Pat. No. 1,780,854 teaches an arrangement wherein the ends of the piston rods are pivotally connected near the periphery of eccentrics.

U.S. Pat. No. 1,612,985 (Quick) teaches a radial engine wherein a multi-layer connecting ring is provided on an eccentric shaft and the piston rods extending from each piston have arcuate shoes adapted to follow in different concentric paths in the connecting wheel. The shoes are fixed to the connecting rods and the connecting rods are pivoted to the piston heads. This arrangement causes problems in that the shoe fixed to the piston rod has a curvature the center of which will change depending on the angle of the piston rod relative to the axis between the center of the piston and the center of the connecting ring. The clinching moment of the shoe in the connecting ring and grooves will be relatively great causing the apparatus to be inoperative. The complexity of manufacturing such an engine with different length piston rods and the complicated connecting ring adds to the disadvantages which would result from this construction.

U.S. Pat. No. 1,783,589 teaches an arrangement wherein a pivotally connected shoe at the end of a piston rod is guided in the tracks of an eccentric. However, because each shoe has to travel the entire periphery of the eccentric, the velocity of the shoe relative to the eccentric is unrealistically high. U.S. Pat. No. 2,105,846 teaches another arrangement which is also very complicated and, therefore, not very practical. Finally, U.S. Pat. No. 2,120,657 teaches a further cam and roller arrangement and suffers the same disadvantages as previously mentioned cam and roller arrangements.

SUMMARY OF THE INVENTION

It is, therefore, an object of the invention to provide a radial engine which is both simple in design and overcomes the above disadvantages.

In accordance with the present invention, a radial engine comprises: a housing and a plurality of equally spaced openings disposed in ring-like arrangement on the periphery of said housing. A respective piston and cylinder arrangement is provided in each opening and a piston rod is connected at one end to the respective piston and extends inwardly from the piston through its respective opening to a shoe pivotally attached at the other end of the piston rod. A connecting ring is mounted for circular translation motion on a crankshaft in the housing. Each shoe is slidably connected to the rim of said connecting ring. A guide means extends radially inwardly in the housing in line with each said piston rod to permit radial reciprocating movement of the piston rods and shoes and transmits the lateral forces to the housing. The piston is free of any lateral forces.

BRIEF DESCRIPTION OF THE DRAWINGS

The invention will be better understood by an examination of the following description together with the accompanying drawings, in which:

FIG. 1 is a radial plan view partly in section of an embodiment of the invention;

FIG. 3 is a perspective view of one embodiment of the shoe as shown in FIGS. 1 and 2;

DESCRIPTION OF THE PREFERRED EMBODIMENTS

Figure 2:
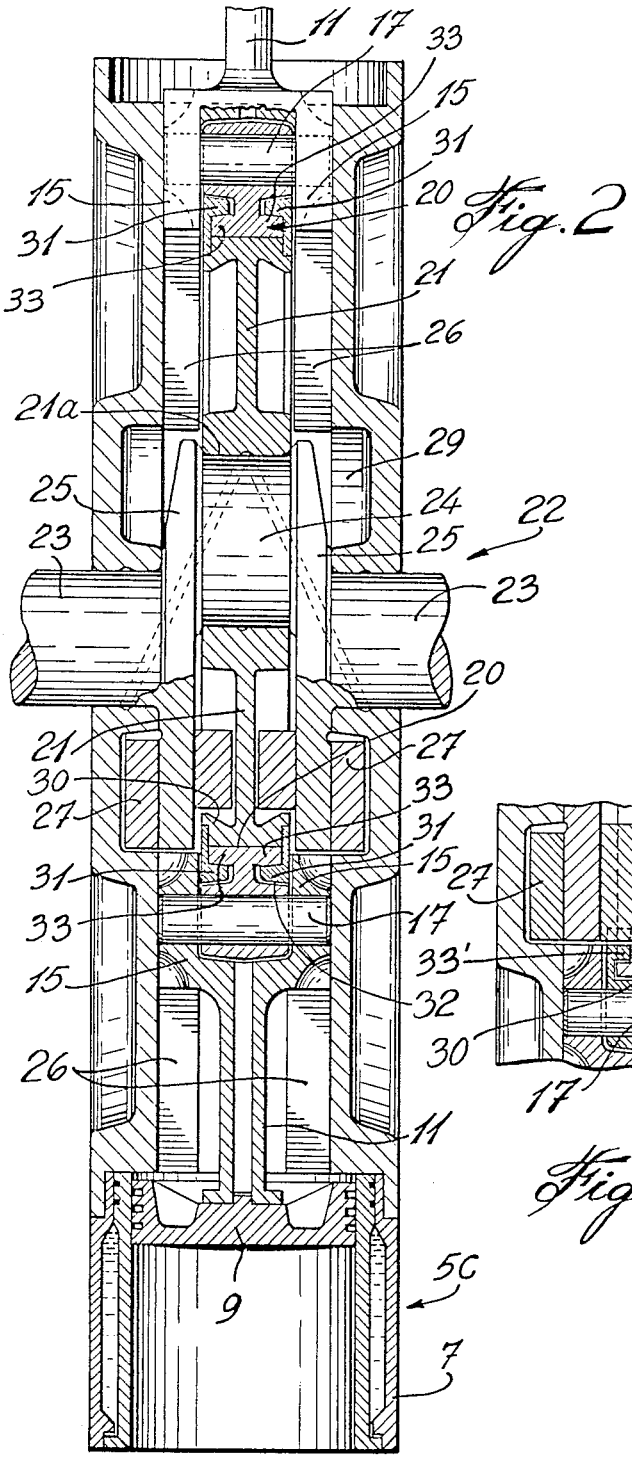
FIG. 2 is an axial cross section through line II—II in FIG. 1.

Referring now to FIGS. 1 and 2, the radial engine comprises a housing, indicated generally at 1, and includes a plurality of openings 3 equally spaced in ring-like arrangement around the periphery of the housing 1. Disposed in each of the openings are piston and cylinder arrangements 5A to 5E. Each piston and cylinder arrangement 5 includes a cylinder 7 and a piston 9 arranged for radial reciprocal movement within its respective cylinder 7. A piston rod 11 is fixed to the piston 9 and extends inwardly from the piston 9 through its respective opening. As is well known in the art, each piston and cylinder arrangement is provided with a suitable means for firing (for example, a spark plug), air and fuel inlets and exhaust outlets. These are not illustrated in the drawings.

As seen in FIGS. 2 and 3, each of the shoes 13 includes a carrier block 15 which has a spindle 17 extending therethrough. The carrier block 15 is integral with the piston rod 11. The spindle 17 is journaled in a sleeve 19 which is integral with a pivoting shoe element 18 which includes a web 22 and an arcuate pressure plate 20. A pair of opposed radial channels 26 are provided in the housing 1 relative to each shoe 13. The channels 26 guide the blocks 15 to allow radial movement of the respective shoes 13 and transfers lateral forces (torque) to the housing.

Within the housing 1 there is a connecting ring 21. The connecting ring 21 is journaled on a crankshaft arrangement including main journal 23 and the crank pin 24. The crankshaft is a monoblock one-cylinder type. The axis S of the crankshaft 23 is disposed at the center of the housing, and the axis C of the crank pin 24 is offset from this center. The connecting ring 21, which is made in two halves, includes a friction bearing **21*a* on the crank pin 24 such that the connecting ring 21 is rotatable relative to the crank pin 24**.

As seen in FIG. 2, the main journal 23 and the crank pin 24 are forged together with main journal connecting arms 25, and counterweights 27 are disposed on the arms 25 in a position opposed to the position of the crank pin 24. Space 29 is included in housing 1 to permit passage of the counterweights 27 in a circular path through the housing.

The rim 30 of the connecting ring 21 includes side plates 31 provided with flanges 32. The inwardly directed flanges 32 form a guiding track for flanges 33 of the arcuate pressure plate 20 of the shoes 13.

The arcuate pressure plate 20 constitutes arcs of a circle which have the same radius as the radius of the rim 30 of the connecting ring 21. Thus, with the arrangement as illustrated, the shoes 13 will slide easily along the rim 30 in the track formed by the peripheral flanges 32 of the connecting ring 21.

Figure 4:
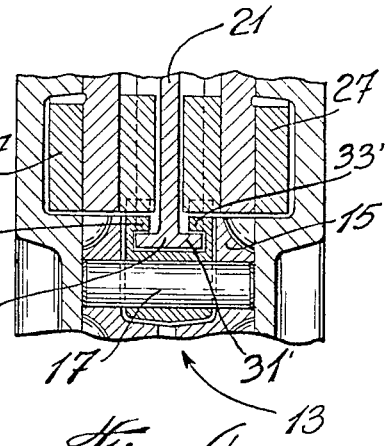
FIG. 4 is a fragmentary axial cross section illustrating an alternate form of the shoe.

In the alternate embodiment illustrated in FIG. 4, the flanges 33' of the shoe 13 are inwardly directed, while the flanges 31' at the periphery of the connecting ring 21 are outwardly directed. In this embodiment the shoe 13 defines the track which contains the rim 30 including flanges 31' of the connecting ring 21.

In operation, the engine works as follows:

The connecting ring 21 will follow a circular translatory path in the direction of the arrow A in FIG. 1 so that the axis C of the crank pin 24 has a locus of a circle with its center at the axis S of the main journal 23. Each piston and cylinder arrangement 5A–5E is adapted to fire following the firing order A-C-E-B-D in a four stroke arrangement. When the piston and cylinder arrangement fires, the piston 9 is forced downwardly, and as the connecting ring 21 is just past top dead-center in the clockwise direction, the ring 21 will be pushed down in the clockwise direction by the action of the shoe 13 on the rim 30 of the connecting ring 21. As the ring 21 follows its translatory path in the clockwise direction, it will force the succeeding pistons upwardly to their compression or exhaust stroke. In FIG. 1, cylinder 5A illustrates the condition when the connecting ring 21 is at top dead-center (firing position). Cylinder 5B is at the end of its exhaust stroke, while cylinder 5C is moving upwardly in its compression stroke prior to firing.

Because the shoes 13 are pivotally connected at the ends of the piston rods, and because the shoes are guided in channels 20, lateral forces will be transmitted to the blocks 15 and then will be transferred to the housing 1 itself.

As can be seen from the drawings, the housing is of simple uniform shape with practically no heat stress or uneven deformation caused by thermal expansion. The simplicity of the housing leads to reduced cost of the engine because of simple machining, casting and weight reduction.

When maximum forces are acting on the piston of the firing cylinder, practically no sliding will occur between the connecting ring 21 and the shoe 13 due to frictional forces which are proportional to pressure. When there are no considerable forces acting on a piston, then the connecting ring 21 will slide easily through the shoe 13. The ring 21 slides little relative to the shoe 13 since the ring 21 is journaled to the crank pin 24.

As can be seen, the primary inertia forces are totally balanced by the counterweights on the crankshaft, and the secondary forces are naturally balanced by the number and disposition of cylinders.

The spaces between the cylinders may be used to house the alternator, water pump, power steering, turbo charger, AC compressor, starter, etc.

Figure 5:
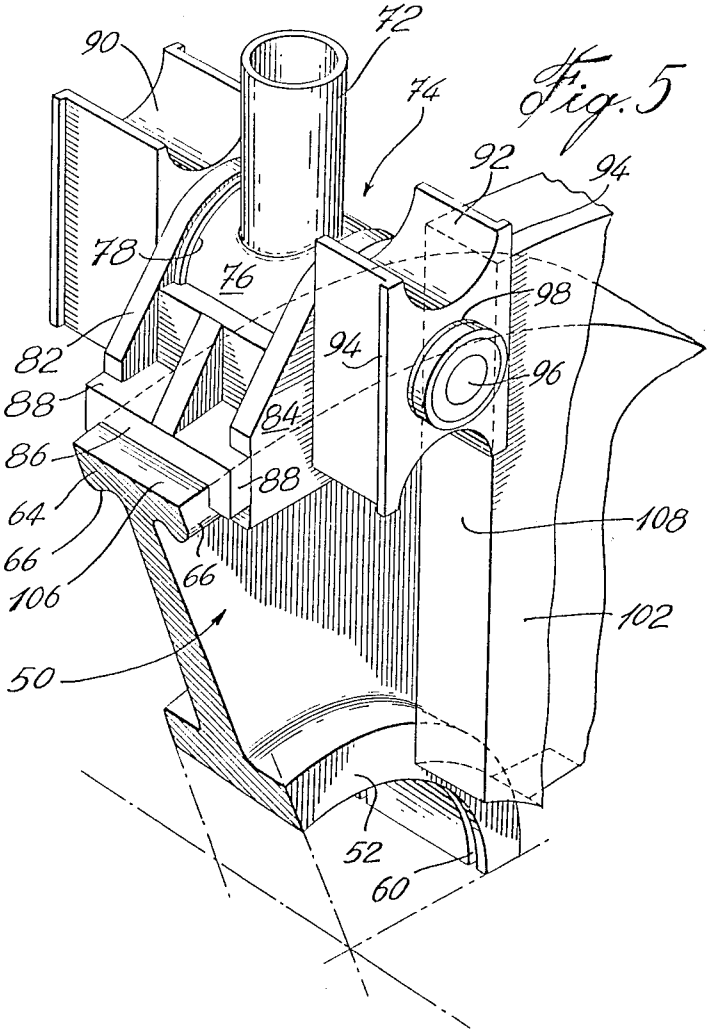
FIG. 5 is a fragmentary perspective view of a detail of a further embodiment of the present invention.

The embodiment shown in FIGS. 5 and 6 will now be described. The decagonal block 104 and housing covers 48 define a crankcase 46 in which there is provided a connecting ring 50. The connecting ring 50 corresponds to connecting ring 21 in the previously described embodiment and the general arrangement of the engine is the same as that shown in FIGS. 1 and 2.

The rim 64 of the connecting ring 50 includes annular beads 66. The connecting ring 50 also includes a hub 52 adapted to house the crank pin roller bearings including an outer race 54, an inner race 56 and rollers 58. The roller bearing is held within the hub 52 by means of snap rings 62 inserted in annular grooves 60.

Figure 6:
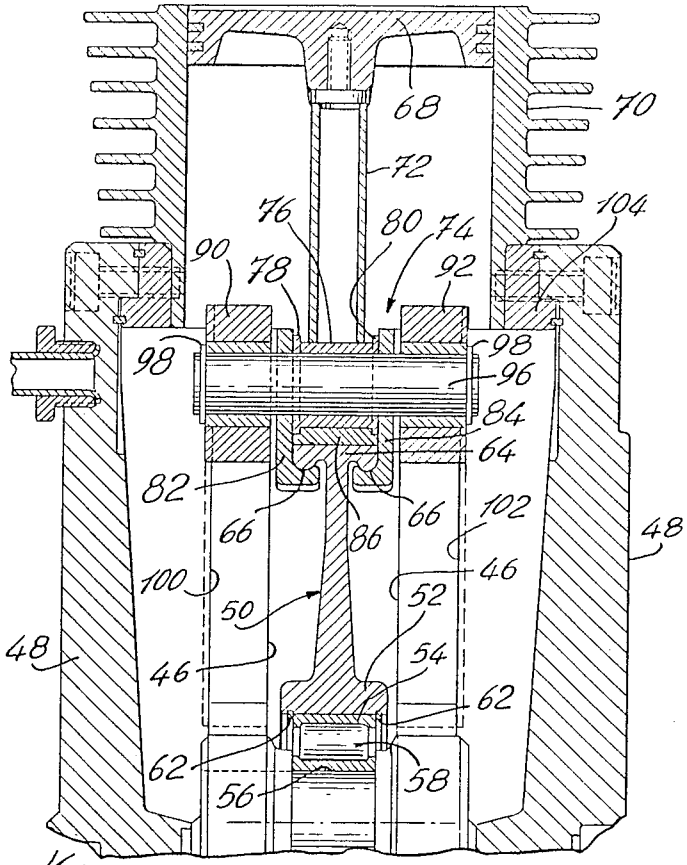
FIG. 6 is an axial partial cross section of the detail shown in FIG. 5.

The piston is partly illustrated at 68 in FIG. 6 and includes a piston rod 72 which is fixed thereto at one end thereof and which mounts shoe 74 at the other end. Shoe 74 includes a sleeve 76 which is integral with the end of the piston rod 72. The spindle 96 is fitted into sleeve 76. Sleeve 76 includes flanges 78 and 80 at each end thereof.

A pair of claw plates 82 and 84 are provided on either side of the sleeve 76. The claw plates 82 and 84, as shown in FIG. 6, engage the beads 66 of the rim 64 of the connecting ring 50. An arcuate pressure plate 86 is interlocked within the claw plates 82 and 84. The arcuate pressure plate 86 has angular fingers 88 at each corner thereof which slidably guides the claw plates 82 and 84, as shown in FIG. 5, so that the arcuate pressure plate 86 and the claw plates 82 and 84 are always concentric with the beads 66.

Lateral shoes 90 and 92 are provided on each end of the spindle 96 and are held thereon by means of locking rings 98. The lateral shoes 90 and 92 are adapted to slide in guides 100, 102 fixed to decagon block 104. The lateral shoes 90 and 92 slide in these radial guides 100, 102 in the same manner as block 15 slides in the channels 26 in FIG. 2. Thus, as the crankshaft is made to rotate by means of the successive firings of the piston and cylinder arrangements, the piston rod 72 for instance, through the shoe assembly 74, applies pressure on the rim 64 of the connecting ring 50. The lateral shoes 90 and 92 which slide in guides 100 and 102 prevent any deviation from the straight line of the piston rod 72. The pivoting shoe 74 is adapted to provide for any angular changes from the translation movement of the connecting ring 50. Although the rim 64 of the connecting ring 50 does not slide too much within the shoe 74, there is some sliding movement and the present arrangement maintains friction to a minimum.

Surface 106 of the connecting ring 50 is lubricated and cooled by an oil spray. Sliding surfaces 108 of the guides 100 and 102 are pressure lubricated. Piston and cylinder, crank pin roller bearings, and main crankshaft needle bearings (not shown) are oil-mist lubricated. Lubrication is of the dry sump type (pressure and scavenging pumps are provided).

I claim:

1. A radial engine comprising:

a housing;

a plurality of equally spaced openings disposed in ring-like arrangement on the periphery of said housing;

a piston and cylinder arrangement in each said opening, a piston rod for each arrangement fixed to and extending radially inwardly from its respective piston and through its respective opening;

shoe means pivotally attached at the other end of each said piston rod;

radial guide means extending in said housing in line with each of said piston rods, and said shoe means provided with guide means followers to ensure radial reciprocal movement of the piston rods and shoe means; and a connecting ring journaled on a crankshaft for circular translation motion in said housing, the ring including a circular rim;

each said shoe means including an arcuate follower member being slidably connected to the rim of said connecting ring.

2. An engine as defined in claim 1, wherein said connecting ring is circular in shape;

said follower member including an arcuate follower portion for engaging the rim of said connecting ring;

said arcuate follower having an arcuate shape and comprising the arc of a circle having the same radius as the radius of said rim.

3. An engine as defined in claim 2, wherein the rim of said connecting ring comprises inwardly directed flanges;

and wherein the arcuate follower member of said shoe means comprises outwardly directed flanges;

the flanges of said connecting ring overlapping and guidably restraining the flanges of said shoes.

4. An engine as defined in claim 2, wherein the rim of said connecting ring comprises outwardly directed flanges;

and wherein said shoes comprise inwardly directed flanges;

the flanges of said shoes overlapping and restraining the flanges of said connecting ring;

whereby said shoes are connected to and guided by the rim of said connecting ring.

5. An engine as defined in claim 1, wherein said connecting ring is mounted on a crankshaft in said housing;

the axis of the crank of the crankshaft being disposed at the center of the connecting wheel;

the axis of the shaft of the crankshaft being at the center of said housing;

whereby, in operation, the locus of said center of said connecting wheel is a circle having the center of said housing as its center.

6. An engine as defined in claim 1, wherein each said piston and cylinder arrangement includes a firing means, and air and fuel inlet means and exhaust means.

7. A radial engine as defined in claim 1, wherein the shoe means includes a sleeve fixed to the end of a piston rod, a spindle journaled within the sleeve at right angles to the piston rod and extending parallel to the rotating axis of the shaft, a pair of claw plates mounted on the spindle, one on each side of the sleeve, and a separate arcuate pressure plate interlocked between the separable claw plates, such that the arcuate pressure plate is slidable on the rim of the connecting ring and the claw plates include flanges extending underneath the rim of the connecting ring such that the shoe is retained for sliding and pivoting movement on the rim of the connecting wheel, and a pair of lateral shoes are provided on the spindle on each end thereof adapted to move in radial guide means and locking means are provided on each end of the spindle for locking the separable members thereon.

* * * * *